US005458968A

United States Patent [19]

Bittle et al.

[11] Patent Number: 5,458,968

[45] Date of Patent: Oct. 17, 1995

[54] FIBER BUNDLES INCLUDING REVERSIBLE CRIMP FILAMENTS HAVING IMPROVED DYEABILITY

[75] Inventors: David F. Bittle; Gary J. Capone, both Decatur, Ala.

[73] Assignee: Monsanto Company, St. Louis, Mo.

[21] Appl. No.: 373,909

[22] Filed: Jan. 17, 1995

Related U.S. Application Data

[63] Continuation of Ser. No. 188,174, Jan. 26, 1994, abandoned.

[51] Int. Cl.[6] ..... D02G 3/00

[52] U.S. Cl. ..... 428/357; 428/364; 428/370; 428/394; 57/244; 57/245; 57/905

[58] Field of Search ..... 428/357, 364, 428/373, 374, 370, 369, 394; 57/244, 245, 905

[56] References Cited

U.S. PATENT DOCUMENTS

| | | | |
|---|---|---|---|
| 2,837,500 | 6/1953 | Andres et al. . | |
| 2,988,420 | 6/1961 | Ryan et al. . | |
| 3,038,237 | 6/1962 | Taylor, Jr. . | |
| 3,038,238 | 6/1962 | Wu . | |
| 3,038,240 | 6/1962 | Kovarik . | |
| 3,039,174 | 6/1962 | Radow et al. . | |
| 3,039,524 | 6/1962 | Belck et al. . | |
| 3,065,042 | 11/1962 | Bradley . | |
| 3,092,892 | 6/1963 | Ryan, Jr. et al. . | |
| 3,217,734 | 11/1965 | Fitzgerald . | |
| 3,242,243 | 3/1966 | Knudsen . | |
| 3,295,552 | 1/1967 | Powell et al. . | |
| 3,350,872 | 11/1967 | Gorrafa . | |
| 3,515,627 | 6/1970 | Sekiguchi et al. . | |
| 3,547,763 | 12/1970 | Hoffman, Jr. . | |
| 3,671,619 | 6/1972 | Fitzgerald et al. | 264/168 |
| 3,792,944 | 2/1974 | Chimura et al. | 425/131 |
| 3,864,447 | 2/1975 | Sekiguchi et al. | 264/168 |
| 4,071,596 | 1/1978 | Davis | 264/168 |
| 4,284,598 | 8/1981 | Craig, Jr. | 425/464 |
| 4,297,412 | 10/1981 | Achard et al. | 428/370 |
| 4,307,054 | 12/1981 | Chion et al. | 428/373 |
| 4,309,475 | 1/1982 | Hoffman, Jr. | 428/370 |
| 4,332,762 | 6/1982 | Lynch | 264/168 |
| 4,999,245 | 3/1991 | Orino et al. | 428/374 |
| 5,017,116 | 5/1991 | Carter et al. | 425/131.5 |
| 5,130,195 | 7/1992 | Sampanis et al. | 428/370 |
| 5,232,647 | 8/1993 | Sampanis et al. | 264/168 |

FOREIGN PATENT DOCUMENTS

| | | |
|---|---|---|
| 0330766 | 9/1989 | European Pat. Off. . |
| 0490052 | 6/1992 | European Pat. Off. . |
| 1-239161 | 2/1989 | Japan . |
| 1-239127 | 2/1989 | Japan . |
| 1-229814 | 4/1989 | Japan . |
| 1-229813 | 4/1989 | Japan . |
| 1-229812 | 4/1989 | Japan . |

OTHER PUBLICATIONS

Textile Research Journal, vol. 37, Jun., 1967, pp. 447–453, "Mixed–Stream Spinning of Bicomponent Fibers", Authors–Fitzgerald and Knudsen.

*Primary Examiner*—N. Edwards

[57] ABSTRACT

A bicomponent, reversible crimp filament useful in textile and fabrics applications is disclosed. The filament is characterized by a total shrinkage of between about 25 percent and about 50 percent, a fiber shrinkage of between about 2 percent and about 20 percent, a crimp shrinkage of about 20 percent and about 38 percent and a basic dye level of less than about −8.

6 Claims, 2 Drawing Sheets

FIBER BUNDLES INCLUDING REVERSIBLE CRIMP FILAMENTS HAVING IMPROVED DYEABILITY

This is a continuation, of application Ser. No. 08/188,174, filed on Jan. 26, 1994, now abandoned.

BACKGROUND OF THE INVENTION

1. Field of the Invention

The present invention is directed to bicomponent reversible crimp filaments. More specifically, the present invention is directed to bicomponent, reversible crimp acrylic filaments which have improved dye uptake characteristics over prior art reversible crimp filaments and a bundle of such filaments.

2. Description of the Prior Art

Reversible crimp, bicomponent filaments are well known and desirable for use in fabrics because of their good bulk, cover, soft hand and resilience. These filaments are typically constructed of two fiber-forming polymeric components which differ in their respective abilities to shrink or swell upon exposure to a shrinking or swelling agent. These filaments are typically formed by extruding these two polymeric components through capillaries in a spinneret so that the resulting filaments have discrete, separate regions of each polymer along their lengths.

For example, bicomponent, reversible crimp filaments may be formed from polymeric components which have a marked difference in hydrophilicity due to differences in the amount of water-ionizable groups between the two components. After exposure to water, these filaments can be dried to develop a crimp, often helical in shape. The crimp decreases upon wetting and reforms upon drying; therefore, the crimp is said to be "reversible".

These types of filaments are disclosed in U.S. Pat. Nos. 3,038,238; 3,038,240; and 5,130,195. They have also been available commercially, for example, from Monsanto Company under the trade names PA-QEL® and REMEMBER® and from E.I. du Pont de Nemours and Co. previously under the designation SAYELLE® and more-recently under the trade name ORLON®.

While the crimp reversibility of these fibers is their most attractive feature, they preferably also exhibit other characteristics which are desirable in fibers generally when used in textile applications. For example, as described in U.S. Pat. No. 3,065,042, shrinkage is of particular importance in the attainment of good fabric cover. Further, a rapid dye uptake rate for the fiber translates into increased dyed product manufacturing speeds.

Although the above commercial products have been successful, they have lacked some of the more general features mentioned above. For example, the REMEMBER® product, while exhibiting a relatively rapid rate of dying, also exhibits a degree of total shrinkage which, while acceptable, is improvable. The SAYELLE® DuPont-manufactured product, while exhibiting a highly desirable degree of total shrinkage and reversible crimp, also is characterized by a relatively slow dye uptake rate.

The need therefore exists for a bicomponent, reversible crimp filament which has a combination of high dye uptake rate and high degree of shrinkage and while maintaining the crimp reversibility and corresponding aesthetic qualities for which these types of fibers are noted.

SUMMARY OF THE INVENTION

The present invention achieves these and other desirable results by providing a fiber bundle consisting essentially of bicomponent, acrylic filaments having a total shrinkage between about 25 percent to about 50 percent, a fiber shrinkage of between about 2 percent and about 20 percent, a crimp shrinkage of about 20 and about 38, and a basic dye level of less than −8 when these parameters are measured by at least one of the appropriate tests set forth below. The bundle can be processed into yarns which are useful in the production of fabrics and textiles which are easily and quickly dyeable and which exhibit good bulk and cover and a soft hand.

DETAILED DESCRIPTION OF THE PREFERRED EMBODIMENTS

Figure 1:
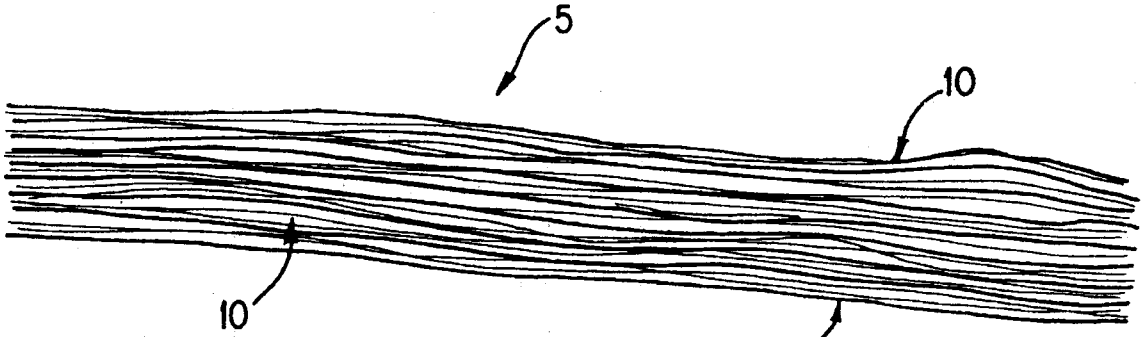
FIG. 1 is a plan view of a fiber bundle of the present invention.
Figure 3:
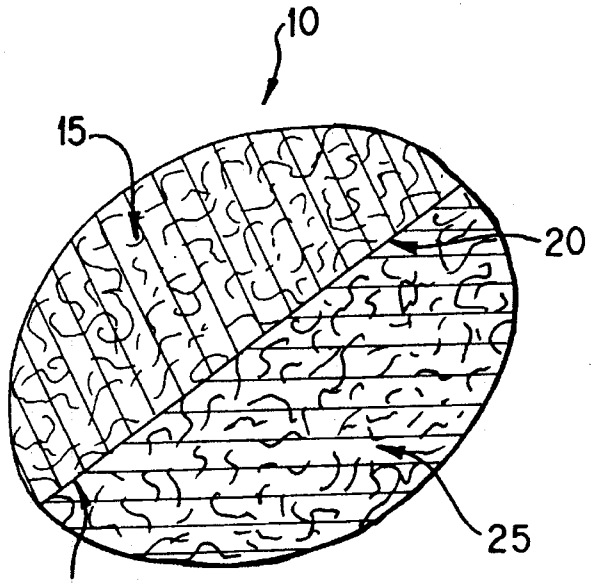
FIG. 3 is an enlarged cross-section of one representative filament of the bundle portion of FIG. 2.
Figure 2:
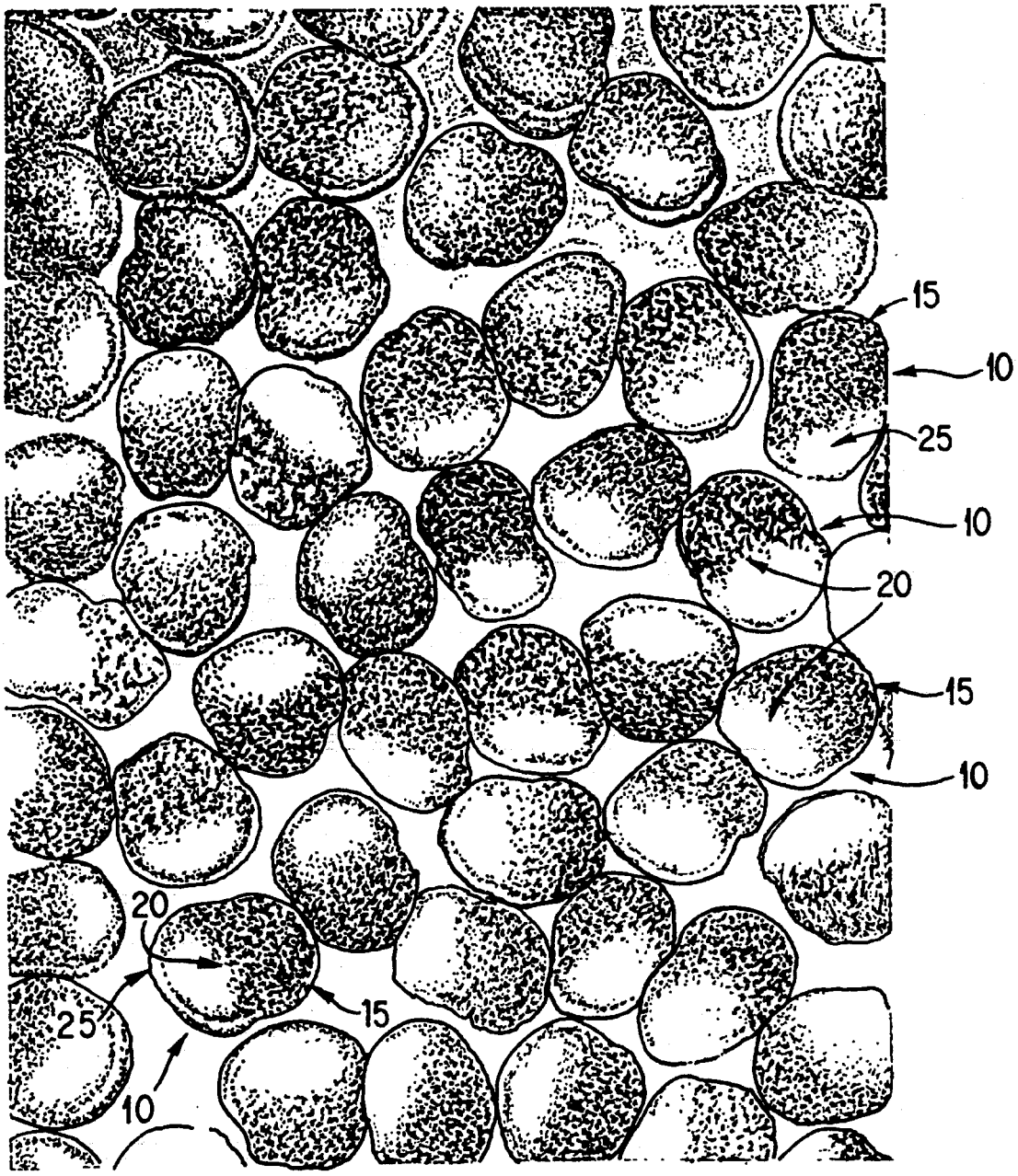
FIG. 2 is a cross section of a representative portion of the fiber bundle of the present invention.

As shown in FIGS. 1–3, the bicomponent filaments 10 of the bundle 5 of the present invention include a first component 15 and a second component 25 coextensive with the first component 15 along the length of the filament 10. Preferably, the filament includes from about 20 percent to about 80 percent by weight of the first component 15 based on the total weight of the filament and from about 80 percent to about 20 percent by weight of the second component 25 based on the total weight of the filament. Most preferably, the first component 15 and the second component 25 have a single interface 20 therebetween.

The first component 15 is formed from a first acrylonitrile-based polymer which preferably is more hydrophilic than a second acrylonitrile-based polymer from which the second component 25 is formed. "Acrylonitrile-based polymers" are defined as polymers with at least about 85 percent by weight acrylonitrile groups.

Preferably, both polymeric materials further include an amount of sulfonate groups. The sulfonate groups may be present in the polymer via (1) the presence of specific sulfonate-containing comonomers in the polymer; (2) sulfonate groups derived from a redox catalyst system, for example a persulfate/bisulfite system, which attach to non-sulfonate-containing monomers in the polymer; or (3) a combination of (1) and (2). Preferably, the polymers also include a vinyl-containing monomer, for example vinyl acetate, methyl acrylate, methyl methacrylate, vinylidene chloride, vinyl bromide and styrene.

Non-limiting examples of (1) include sodium allyl sulfonate, sodium methallyl sulfonate, sodium styrene sulfonate, sodium p-sulfophenyl methallyl ether, sodium 2-methyl-2-acrylamidopropane sulfonate and acrylamido tertiary butyl sulfonic acid.

As discussed above, the polymer may also include sulfonate groups which are derived from the redox catalyst system employed in the redox polymerization process used to form the polymer. For example, the system may include a persulfate initiator, preferably sodium persulfate, and a bisulfite activator, preferably sodium bisulfite. Use of these materials results in attachment of sulfonate end groups on the polymer which is formed.

As set forth above, the first polymeric material is preferably more hydrophilic than the second polymeric material. The amounts of acrylonitrile and sulfonate groups present in each polymeric material are therefore preferably selected such that the first polymeric material is more hydrophilic than the second polymeric material. Most preferably, the first polymeric material contains at least about 85 weight percent acrylonitrile comonomers, from about 4 to about 12 weight percent vinyl-containing comonomers and sulfonate-containing comonomers in an amount sufficient to provide 0.9 to 3.5 weight percent sulfonate groups, calculated as sulfonate ion, based on the total weight of the polymer.

The second polymeric material most preferably includes at least about 85 weight percent acrylonitrile, from about 4 to about 12 weight percent vinyl-containing comonomers and sulfonate-containing comonomers in an amount sufficient to provide up to 0.4 weight percent sulfonate groups, calculated as sulfonate ion and based on the total weight of the polymer.

Useful vinyl-containing comonomers are represented by the monomer in Formula (I):

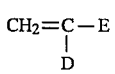

(I)

wherein D and E can be any substituent group such as alkyl, aryl, nitrile, ester, acid, ketone, ether, halogen, or hydrogen. Examples of useful vinyl-containing comonomers include vinyl acetate, methyl acrylate, methyl methacrylate, vinylidene chloride, vinyl bromide, and styrene.

Useful sulfonate containing comonomers are represented by a vinyl monomer with a sulfonate salt or sulfonic acid in Formula (II):

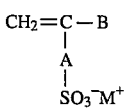

(II)

wherein A is an aromatic or aliphatic substituent and B is either hydrogen or an aliphatic substituent on the vinyl monomer. M+ represents an alkali metal cation, an alkaline earth metal cation, hydronium cation or other suitable counterion to the sulfonate group. Examples of useful sulfonate containing monomers include sodium allyl sulfonate, sodium methallyl sulfonate, sodium styrene sulfonate, sodium p-sulfophenyl methallyl ether, sodium 2-methyl-2-acrylamidopropane sulfonate, and acrlamido tertiary butyl sulfonic acid.

Both polymers may also derive about 0.2 to about 0.3 weight percent sulfonate groups from the redox catalyst system during polymer formation, such that the first polymeric material may contain about 0.9 to 3.8 weight percent sulfonate groups and the second polymeric material may contain up to about 0.7 weight percent sulfonate groups.

A particularly preferred filament of the present invention includes a first component formed from a first polymeric material of 91 weight percent acrylonitrile; 4 weight percent vinyl acetate; 5 weight percent sodium p-sulfophenyl methallyl ether providing 1.6 weight percent sulfonate groups; and 0.2 to 0.3 weight percent sulfonate groups derived from the initiation/activation catalyst system; and a second component formed from a second polymeric material of 93.4 weight percent acrylonitrile, 6 weight percent vinyl acetate, 0.6 weight percent sodium p-sulfophenyl methallyl ether providing 0.2 weight percent sulfonate groups, and 0.2 to 0.3 weight percent sulfonate groups derived from the catalyst system.

Preferably, the bundle of the present invention is produced by the wet spinning process described below.

Initially, the polymeric materials are separately placed into solution using a suitable solvent, preferably dimethylacetamide (DMAc). The solutions may be prepared in conventional mixing equipment and are preferably prepared so that they are homogeneous in final form. Most preferably, the polymer concentrations of both solutions are adjusted such that the final viscosities of the solutions are approximately equivalent. Each solution is then filtered and pumped to separate tanks which provide a supply of spinning solution, or dope, to the spinning machine.

The solutions are then spun to form a plurality of bicomponent filaments, typically referred to as a fiber bundle. A fiber bundle, as utilized herein, is defined as a loosely organized substantially parallel group of at least sixty (60) filaments. In the spinning step, each dope is pumped through heaters and filters with flow pressure control which maintains a constant supply rate of dope to a separate metering pump manifold for each solution. The dope streams are pumped to a spinneret assembly, or pack, which is submerged in a coagulation bath containing about 20 percent to about 70 percent solvent, preferably DMAc, and water, with the bath having a temperature of between 0° C. and 60° C. The filaments are formed by extruding the solutions through capillaries in the spinneret assembly into the coagulation bath, with portions of both dopes being supplied to each capillary in the spinneret assembly.

A first preferred spinneret assembly, or pack, is what is conventionally known as a "pipe-in-pipe" assembly such as that disclosed in U.S. Pat. No. 3,217,734, the disclosure of which is incorporated herein by reference.

A second preferred spinneret assembly, or pack, particularly preferred for producing filament bundles having a larger number of filaments, is disclosed in U.S. Pat. No. 5,017,116, assigned to the assignee of the present invention, the disclosure of which is incorporated herein by reference. Utilization of either of these assemblies results in the production of a filament bundle of the present invention wherein the filaments have a substantially uniform distribution of components along the entire length of each filament and from filament to filament.

The process further includes pulling or drawing the bundle from the coagulation bath, preferably by collecting the filaments on a roll section. Most preferably, the ratio of the linear speed of the filaments at the roller to the dope exiting the capillary is between about 0.1 to about 1.0.

The bundle is then washed to remove excess solvent therefrom. Preferably, this washing step is combined with a drawing step to stretch the filaments, thereby increasing molecular orientation and strength and reducing denier. The washing step preferably includes passing wash water over the filaments in a direction opposite that of the filaments. The drawing step may be performed by collecting the filaments on consecutive rolls wherein the second roll is rotating at a velocity greater than, preferably six times that of, the first roll. In the preferred embodiment wherein the washing step is combined with the drawing step, the wash water temperature is maintained slightly above the wet glass transition temperature of the filaments to maximize molecular orientation during the drawing process.

Conventional acrylic fiber finish components are then applied to the bundle using spraying or other known techniques.

The bundle is then dried, preferably by contact with at least one heated roll, then is relaxed by contact with saturated steam whereby the denier is increased about 25 percent, the tenacity is decreased and the elongation is increased. The relaxed filaments are then stabilized by drawing the filaments while exposed to elevated temperatures of about 115° C. Preferably, the drawing is performed passing the filaments over two sections of steam heated draw rolls wherein the second section is operated at a velocity 25 percent higher than that of the first section.

A conventional finish composition is then applied to the stabilized bundle and the bundle crimped using conventional techniques. The resulting bundle is then converted into staple form and made into skeins of yarn by conventional processing.

While the above process is preferred, other wet spinning processes may be utilized to form the filaments of the present invention. Further, other processes for forming bicomponent acrylic filaments may also be utilized.

The filaments of the present invention are primarily characterized by shrinkage and basic dye level characteristics. Fiber shrinkage (FS) is defined as the irreversible length change of the filament when exposed to heat in an amount sufficient to relieve at least a portion of the internal molecular stresses caused by the molecular orientation achieved during the drawing process. Crimp shrinkage (CS) is defined as the reversible length change of the filament due to the degree of crimp, or bend, along the length of the fiber. Total shrinkage (TS) is defined as the total length change of the filament.

Basic dye level is defined as the extent to and speed with which a filament dyes under a standard set of conditions with a basic dye.

For measuring physical parameters such as shrinkages, filament-based testing, while somewhat tedious, is possible. In filament-based testing for shrinkage, the filament is placed under a heavy load W1 (approximately 0.10 grams per denier [gpd]) to give a length L1. Load W1 is removed and the filament is immersed in water at a temperature of about 95° C. for about 5 minutes. The filament is removed and allowed to cool for about 15 minutes and subsequently placed in a hot air oven at about 80° C. for 5 minutes. The filament is allowed to cool and then is placed under a light load W2 (about 0.001 gpd) which holds the filament vertical without pulling out any crimp to give a length L2. Load W2 is then removed and W1 is then applied to the filament to generate length L3.

The shrinkage parameters are then calculated as follows:

$$FS = \frac{L1 - L3}{L1} \times 100\%$$

$$CS = \frac{L3 - L2}{L3} \times 100\%$$

$$TS = \frac{L1 - L2}{L1} \times 100\%$$

As a matter of convenience, practicality and accuracy, parameters such as these discussed may also be measured on multifilament bundles.

In multifilament testing for shrinkage, a fiber or bundle sample, with ends taped together, is placed under a heavy load W1', preferably about milligrams/denier to give a length L1'. Load W1' is removed and the sample is first submerged in room temperature water for one minute and then relaxed in an autoclave treatment with five psi steam for ten minutes. The sample is then dried in a hot air dryer (air temperature=180° C.) and then allowed to cool to room temperature. The sample is then placed under a light load W2', preferably about 1.9 milligrams/denier, which holds the sample vertical without pulling out any crimp present in the sample and the length of the sample L2' is measured. The load W2' is then removed and load W1' is then reapplied to the sample and sample length L3' is measured.

The shrinkage parameters for the fiber bundles are then calculated as follows:

$$FS' = \frac{L1' - L3'}{L1'} \times 100\%$$

$$CS' = \frac{L3' - L2'}{L1'} \times 100\%$$

$$TS' = \frac{L1' - L2'}{L1'} \times 100\%$$

Basic dye level (BDL) is measured using the multifilament procedure set forth below. In multifilament dye testing, at least one one-gram test sample is procured along with at least one one-gram sample of a standard, typically a monocomponent acrylic fiber formed from a copolymer of about 92.6 weight percent acrylonitrile and about 7.4 weight percent vinyl acetate. The samples are placed in separate pockets of a cloth sample holder (called a "sock").

A dye bath is then formed by mixing in approximately equal volumes of an ammonium acetate buffer and an aqueous dye solution concentrate of Sevron Blue, a C.I.E. basic blue 21 dye commercially available from Crompton and Knowles Corp. The dye solution concentrate consists of the dye in a 10 percent acetic acid aqueous solution in the amount of 10 g dye/l. The amounts of ammonium acetate and dye solution concentrate respectively, in milliliters, are each about equal to the number of grams of fiber to be tested. For example, if the sock contains fifteen one-gram samples, 15 ml of ammonium acetate are combined with 15 ml of dye solution concentrate.

After the ammonium acetate and dye solution concentrate are mixed, the mixture is brought up to a volume of 300 ml by the addition of deionized water to form the final dye bath.

The sock is placed in the dye bath and the container containing the dye bath is then placed in a TURBOMAT TM-6 dying machine available from Ahiba-Mathis, Inc. of Charlotte, N.C.

The samples are dyed over a one hour, fifteen minute period wherein the dye bath temperature is ramped from a starting point of 60° C. to 102° C. in 2° increments per minute, held at 102° C. for forty minutes and ramped down for the remainder of the dyeing period at 6° C. per minute. The sock and the samples contained therein are then rinsed, centrifuged for five minutes and dried. The samples are then removed from the sock and their color measured using a MS2000 spectrometer commercially available from MacBeth. This instrument measures color or brightness values via a comparison between the test sample and the standard. The resulting parameter, $\hat{Y}$, is referred to herein as the basic dye level (BDL) measurement. A lower (i.e. more negative) BDL value is indicative of a deeper and more rapidly dyed test sample.

Using at least one of these procedures for measuring parameters where more than one measurement procedure exists (i.e., filament-based measurement or multifilament measurement), the filaments of the present invention are characterized as having a fiber shrinkage of between about 2 percent and about 20 percent, a crimp shrinkage of between about 20 percent and about 38 percent, a total shrinkage of between about 25 percent and about 50 percent, and a basic dye level of less than about −8.

In preferred embodiments wherein the filaments of the present invention are manufactured using the spinneret assemblies of U.S. Pat. No. 5,017,116 or U.S. Pat. No. 3,217,734, the filaments in the bundle have a substantially uniform distribution of components along the entire length of each filament and from filament to filament.

Most preferably, the component distribution of the filaments in the bundle is that of a "true bicomponent" wherein all of the filaments in the bundle have a single interface 20 between the first components 15 and the second component 25.

The following example, while not intended to be limiting in scope, is provided to further illustrate the present invention. All percentages are by weight unless otherwise indicated.

EXAMPLE I

Two acrylonitrile (AN) based polymers, each having greater than 85 percent of the acrylonitrile in the polymer composition, are prepared in separate solutions with dimethylacetamide (DMAc) solvent. The first polymer solution contains a polymer having 93.4 percent AN, 6.0 percent vinyl acetate (VA), and 0.6 percent Sodium parasulfophenyl methallyl ether (SPME). The second polymer solution contains a polymer having 91 percent AN, 4 percent VA, and 5 percent SPME. Both polymer solutions are prepared using conventional mixing devices to thoroughly wet the polymer with the DMAc solvent. The equipment was heated to elevate the solution temperature to above 80° C. and homogeneous solutions were formed. Conventional additives are combined with the polymer solutions for heat stabilization and luster control. The amount of polymer in each solution is adjusted within the range of 24.5 percent to 25.5 percent solids to control both polymer solutions to the same viscosity, preferably utilizing polymers having a specific viscosity ($\eta_{sp}$) of about 0.155. Each polymer solution is filtered and transferred to separate tanks to provide a supply of spinning solution (dope) to the spinning machine.

Each dope is pumped through heaters and filters with flow pressure control to maintain a constant dope supply to a metering pump manifold. In the pump manifold, there is one pump for the hydrophobic dope and one pump for the hydrophilic dope for each spinning position. Each spinning position is supplied with a constant and equal flow of each dope type with dope temperature control to maintain equivalent dope viscosities. The dope streams are pumped through a spinnerette assembly to provide separate dopes of both dope types to each spinnerette capillary. The spinnerette assembly is submerged in a solvent (DMAc)/non-solvent ($H_2O$) coagulation bath having a DMAc concentration of 52 weight percent and a temperature of 30° C.

The filaments from the bath are pulled through a roll section at the exit of the coagulation bath. The ratio of the roll section linear speed to the linear velocity of the dope exiting the capillary is controlled at about 0.3.

The filaments are then pulled through a combination wash-draw process using a second set of rolls. The second roll set speed is six times the first roll speed to stretch the fiber, increase fiber orientation and strength, and reduce fiber denier. Wash water is passed counter current to the fiber direction and excess solvent is washed from the fiber. The temperature of the wash water is controlled at 98° C. at the fiber exit from the draw section and reduced to 50° C. at the fiber entrance to the wash section. There is a profile of decreasing solvent concentration and increasing fiber temperature through the wash-draw process. The residual solvent is controlled in the final product to 0.3 weight percent.

Conventional finish components are then applied to the wet bundle at the exit of the wash-draw sections to prevent fiber adhesion in the subsequent drying process and to aid textile processing.

The wet bicomponent filaments are then dried using multiple sets of hot rolls. The dried bundle is fed through a steam conditioner and into a crimper to impart mechanical crimp for textile processing. The dry, crimped bundle is collected in containers for the batch annealing process.

The dried bundle is then relaxed using high pressure saturated steam. Containers of fiber are charged to an autoclave and subjected to multiple cycles of saturated steam at 43 psig.

After relaxation, the tow is then heat treated and drawn to stabilize the crimp characteristics and control the fiber shrinkage by pulling the relaxed tow over steam heated hot rolls heated to 115° C. The steam rolls are divided into two sections with each section driven at different speeds. The second section is operated at 25 percent higher speed than the first set to impart orientation in the fiber. A finish is added to the stabilized, stretched fiber and the fiber is crimped for textile processing.

The test procedures defined above for multifilament analysis are used to analyze sixteen items, taken in concurrent pairs, from a 100,000 pound commercial run forming a bundle of about 140,000 filaments. The crimp shrinkage, fiber shrinkage and total shrinkage for these samples are set forth below in Table 1, with the values for two concurrently taken items averaged to denote a single sample.

TABLE 1

| | SHRINKAGE PARAMETERS | | |
|---|---|---|---|
| SAMPLE NO. | FIBER SHRINKAGE (FS), % | CRIMP SHRINKAGE (CS), % | TOTAL SHRINKAGE (TS), % |
| 1 | 12.65 | 27.69 | 40.34 |
| 2 | 5.14 | 33.23 | 38.37 |
| 3 | 6.11 | 31.87 | 37.98 |
| 4 | 17.55 | 27.88 | 45.43 |
| 5 | 12.81 | 27.39 | 40.19 |
| 6 | 16.45 | 27.55 | 43.99 |
| 7 | 13.22 | 29.29 | 42.50 |
| 8 | 16.90 | 29.63 | 46.52 |

EXAMPLE II

A multifilament staple sample was produced in accordance with the procedure set forth in Example I. From this sample, eight filaments were removed and tested in accordance with the filament-based analysis procedure set forth above. The results are summarized below in Table 2.

TABLE 2

| | SHRINKAGE PARAMETERS | | |
|---|---|---|---|
| SAMPLE NO. | FIBER SHRINKAGE (FS), % | CRIMP SHRINKAGE (CS), % | TOTAL SHRINKAGE (TS), % |
| 1 | 6.25 | 20.00 | 25.00 |
| 2 | 6.10 | 35.06 | 39.02 |
| 3 | 3.57 | 28.40 | 30.95 |
| 4 | 6.98 | 33.75 | 38.37 |
| 5 | 6.02 | 44.87 | 48.19 |

TABLE 2-continued

| SAMPLE NO. | SHRINKAGE PARAMETERS FIBER SHRINKAGE (FS), % | CRIMP SHRINKAGE (CS), % | TOTAL SHRINKAGE (TS), % |
|---|---|---|---|
| 6 | 1.25 | 45.57 | 46.25 |
| 7 | 5.75 | 42.68 | 45.98 |
| 8 | 6.90 | 38.27 | 42.53 |
| MEAN: | 5.35 | 36.08 | 39.54 |
| STD. DEV.: | 1.96 | 8.78 | 8.08 |

EXAMPLE III

Using the procedure defined above for multifilament basic dye level (BDL) analysis, five one-gram samples of the filaments of the present invention, in staple fiber form, were compared to six one-gram samples of a bicomponent, water-reversible crimp product commercially available from E.I. du Pont de Nemours and Co. under the trade name ORLON SAYELLE®. The results are set forth below in Table 3.

TABLE 3

| SAMPLE NO | DYE PARAMETERS BDL, PRESENT INVENTION | BDL, ORLON ® PRODUCT |
|---|---|---|
| 1 | −16.55 | −5.15 |
| 2 | −16.51 | −5.55 |
| 3 | −16.69 | −5.91 |
| 4 | −16.59 | −5.38 |
| 5 | −16.66 | −6.10 |
| 6 | | −7.44 |
| AVG | −16.60 | −5.92 |
| SIGMA | +/−0.07 | +/−0.75 |

As clearly demonstrated above, the dyeability of the filaments of the present invention is superior to the subject commercially available product.

While the present invention has been described in detail above, it is to be understood that various modifications may be made without departing from its spirit and scope. For example, any polymer pair which exhibits the desirable difference in hydrophilicity may be utilized in forming the filaments of the present invention. Further, skeins of yarn may be produced from staple which is a blend of staple filaments including the filaments of the present invention. Specifically, the bicomponent filaments of the present invention may be blended with other acrylic filaments to form a useful yarn.

We claim:

1. A fiber bundle consisting essentially of bicomponent, acrylic filaments, said filaments comprising from 20 percent to 80 percent by weight, based on the total weight of the filament, of a first component of a first acrylonitrile-based polymer; and from 80 percent to 20 percent by weight, based on the total weight of the filament, of a second component of a second acrylonitrile-based polymer, said second component being coextensive with said first component and wherein said first acrylonitrile-based polymer is more hydrophilic than said second acrylonitrile-based polymer; and wherein said filament is characterized by a total shrinkage of between 25 percent and 50 percent, and a basic dye level of less than −8.

2. The bundle of claim 1 wherein said filaments exhibit a reversible length change due to the degree of crimp along the length thereof and further comprising a fiber shrinkage of between 2 percent and 20 percent and a crimp shrinkage of between 20 percent and 38 percent.

3. The bundle of claim 2 wherein said total shrinkage is about 44 percent and fiber shrinkage is about 15 percent and said crimp shrinkage is about 29 percent.

4. The bundle of claim 1 wherein said basic dye level is about −16.6.

5. The bundle of claim 1 wherein said filaments in said bundle have a substantially uniform distribution of components along the entire length of each of said filaments and from filament to filament.

6. The bundle of claim 5 wherein all of said filaments have a single interface between said first component and said second component.

* * * * *

UNITED STATES PATENT AND TRADEMARK OFFICE

CERTIFICATE OF CORRECTION

PATENT NO. : 5,458,968

DATED : Oct. 17, 1995

INVENTOR(S) : David F. Bittle; Gary J. Capone

It is certified that error appears in the above-indentified patent and that said Letters Patent is hereby corrected as shown below:

Column 5, line 61, add --80-- after the word "about".

Signed and Sealed this

Twenty-seventh Day of February, 1996

*Attest:*

Bruce Lehman

BRUCE LEHMAN

*Attesting Officer*

*Commissioner of Patents and Trademarks*